US006101915A

United States Patent [19]

Sinclair

[11] Patent Number: 6,101,915

[45] Date of Patent: Aug. 15, 2000

[54] METHOD AND APPARATUS FOR TRIMMING FIREARM CASES AND THE LIKE

[76] Inventor: Eric Sinclair, R.R. 2, Box 168A, Peru, Ind. 46970

[21] Appl. No.: 09/027,778

[22] Filed: Feb. 23, 1998

[51] Int. Cl.[7] ..... F42B 33/10

[52] U.S. Cl. ..... 86/24; 86/36; 29/1.32; 409/140

[58] Field of Search ..... 29/1.3, 1.32; 86/23, 86/24, 36–38, 40, 44; 82/113; 408/202, 211; 409/140

[56] References Cited

U.S. PATENT DOCUMENTS

| | | | |
|---|---|---|---|
| 2,869,413 | 1/1959 | Anderson | 86/24 |
| 3,174,390 | 3/1965 | Jacobsen | 29/1.32 |
| 3,555,641 | 1/1971 | Lee | 29/1.32 |
| 4,325,282 | 4/1982 | Schaenzer | 29/1.32 |
| 4,405,269 | 9/1983 | Hertzler | 29/1.32 |
| 4,468,829 | 9/1984 | Christensen | 408/211 |
| 4,686,751 | 8/1987 | Gracey | 29/1.32 |
| 4,813,827 | 3/1989 | Dugger | 29/1.32 |
| 4,860,453 | 8/1989 | Carroll | 29/1.32 |
| 5,180,260 | 1/1993 | Phillips, Sr. | 408/211 |
| 5,309,801 | 5/1994 | Markle | 82/128 |
| 5,415,670 | 5/1995 | Schmidt | 29/1.32 |
| 5,727,295 | 3/1998 | Gracey | 29/1.32 |

*Primary Examiner*—Harold J. Tudor
*Attorney, Agent, or Firm*—Ryan M. Fountain

[57] ABSTRACT

A case trimming apparatus is provided having a hollow, longitudinally extending housing which is open at both ends, receiving and securing a cutting tool at one end and enclosing the cutting edge of that tool while rotatably receiving the open end of a case at its other end and retaining the case in alignment with the cutting edge. The end of the housing which receives the open end of the case includes a ledge to engage the shoulder of the case rather than engage the case by its diameter. The ledge can be removably mounted in the housing. The housing includes a chamber for retaining shavings and may include an opening from that chamber to remove shavings during trimming. Manual actuation is accomplished by rotation of the case relative to the housing while applying pressure to the case toward the cutting edge. An adapter is provided for connecting the housing to a standard power tool, such as a conventional electric hand drill, in order to provide an alternative rotary power source.

14 Claims, 1 Drawing Sheet

METHOD AND APPARATUS FOR TRIMMING FIREARM CASES AND THE LIKE

BACKGROUND AND SUMMARY OF THE INVENTION

The present invention relates generally to methods and apparatus for preparing firearm cartridges and, more particularly, for trimming reusable cases in preparation for reloading of cases to create additional cartridges.

A wide variety of firearm cartridges are known, each type sized according to the firearm it is used with. In general, however, each such cartridge comprises a case having an open end, propellant inserted within the case (such as gunpowder), a bullet inserted within and often protruding from the open end of the case. A primer is often attached to the case at the end opposite the bullet. In use, the primer is struck by a firing pin and ignites the propellant to force the bullet out of the case and from the firearm toward the target. As that happens, the explosive forces typically change the shape of the case somewhat, fire forming it radially to the dimensions of the firearm chamber and extending or lengthening it longitudinally.

It has been found to be particularly advantageous to reload spent cases with primer, propellant and bullet and reuse the additional cartridge with the same firearm. For example, since commercially produced firearms of a given type have some minute differences in cartridge chamber dimensions, commercially produced cartridges must be sized slightly small in order to be usable in all such firearms. Unfortunately, sizing the cartridge in that manner produces combustion inefficiencies and variances in firearm operating characteristics. However, spent cases from a given firearm have been fire formed to the specific firearm chamber dimensions. When reused, explosive force previously expended to radially expand the case is then available to increase the longitudinal force on the bullet.

In order to reuse the case in an efficient and safe manner, the excess longitudinal dimension of the case caused by the previous use must be trimmed off. Various prior devices and methods are known for achieving that trimming. In general, the case was secured within a chuck or collet by clamping the case about its diameter with the open end of the case protruding. Since each size or caliber of cartridge employed a case having a different diameter, such chucks were either adjustable to create differently sized openings to receive a variety of cases or substitutable into the device, with specific chucks for specific sized cases. Prior trimming devices also included a rotatable cutting tool aligned on a stand opposite the chuck opening and movable longitudinally toward the open end of the case. The overall configuration resembled a small lathe.

The cutting edge of the cutting tool was typically exposed to the user, and different sized cases often required the use of different removable pilot pieces inserted into the cutting tool adjacent the cutting edge to ensure proper alignment. Also, many such prior devices did not confine the shavings from the trimming process, instead allowing shavings to fall away from the cutting edge and onto the stand supporting the trimming components or the surface or floor supporting the stand. Rotation of the cutting tool was accomplished manually or by connection to a rotary power source.

Accordingly, it is an object of the present invention to provide an improved method and apparatus for trimming firearm cases. Further objects include the provision of a case trimming apparatus which:

a. is more compact and less costly to manufacture, b. more easily and reliably aligns the case with the cutting tool, c. is safer and cleaner to use, d. accommodates a wider variety of case sizes with fewer specialized parts, and e. is adaptable to either manual or power driven actuation.

These and other objects of the present invention are attained by the provision of a case trimming apparatus having a hollow, longitudinally extending housing which is open at both ends, receiving and securing a cutting tool at one end and enclosing the cutting edge of that tool while rotatably receiving the open end of a case at its other end and retaining the case in alignment with the cutting edge. The end of the housing which receives the open end of the case includes a ledge to engage the shoulder of the case rather than engage the case by its diameter. The ledge can be removably mounted in the housing. The housing includes a chamber for retaining shavings and may include an opening from that chamber to remove shavings during trimming. Manual actuation is accomplished by rotation of the case relative to the housing while applying pressure to the case toward the cutting edge. An adapter is provided for connecting the housing to a standard power tool, such as a conventional electric hand drill, in order to provide an alternative rotary power source.

Additional objects, advantages and novel features of the present invention will become readily apparent to those skilled in the art from the following drawings and detailed description of preferred embodiments.

DETAILED DESCRIPTION OF PREFERRED EMBODIMENTS

Figure 1:
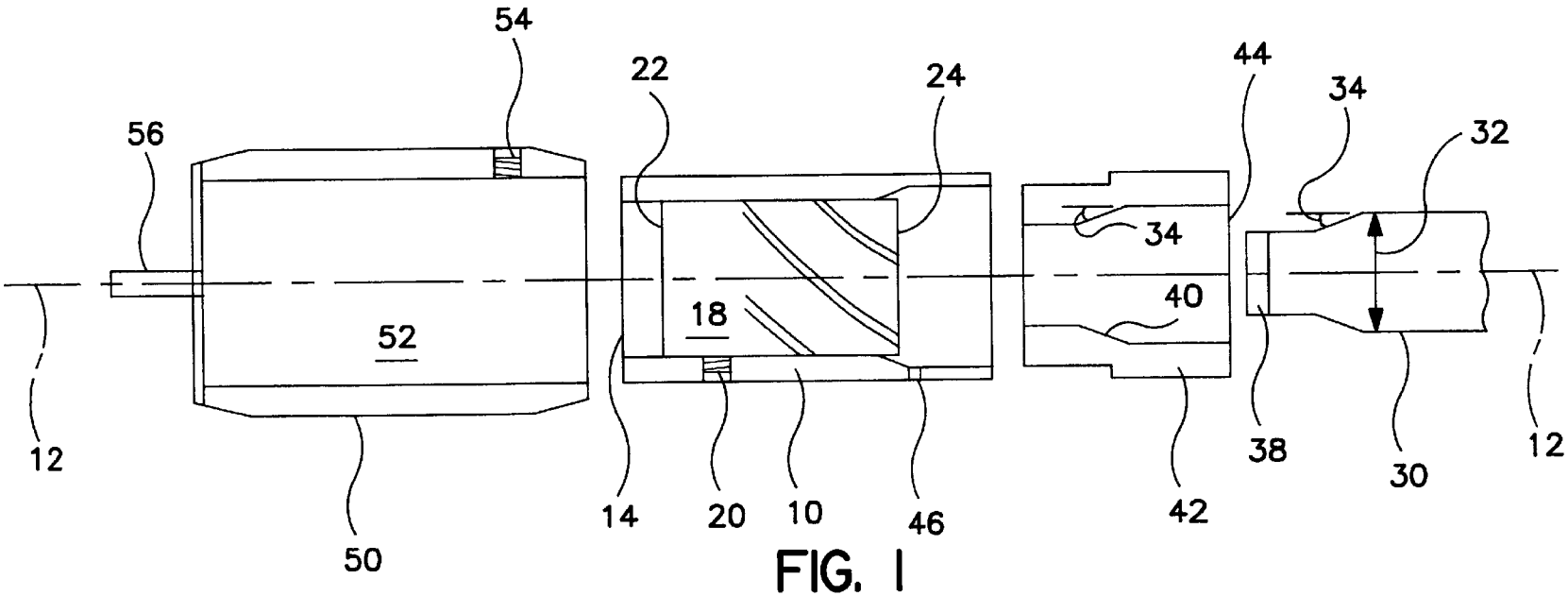
FIG. 1 shows an exploded cross-sectional side view of a case trimming apparatus according to the present invention.
Figure 2:
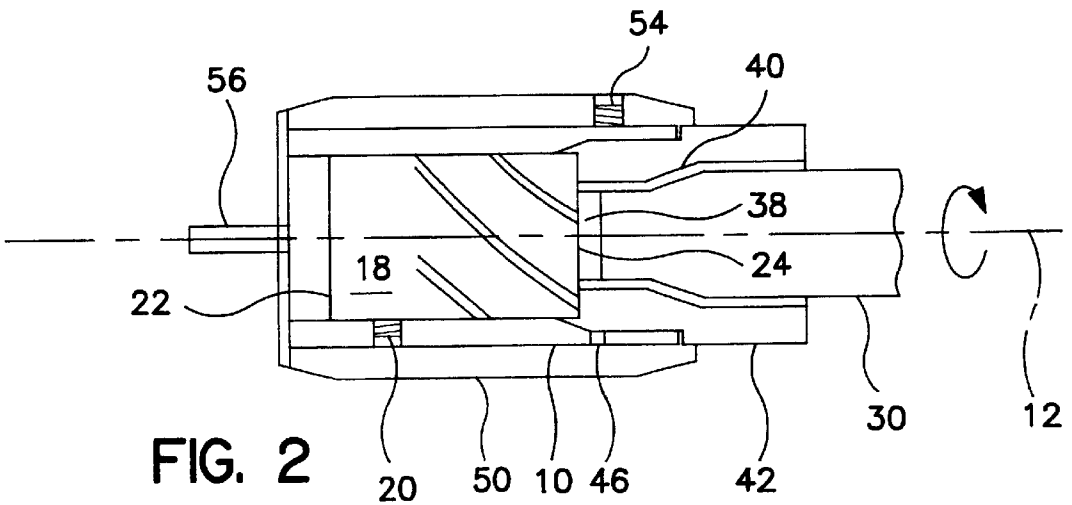
FIG. 2 is an assembled cross-sectional side view of the case trimming apparatus of FIG. 1.
Figure 3:
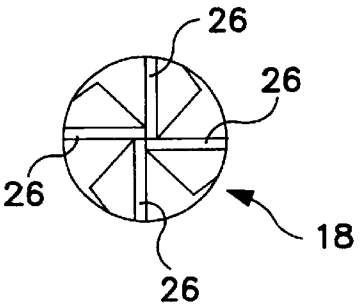
FIG. 3 is a cutting end view of the cutting tool shown in the case trimming apparatus of FIG. 1.

FIGS. 1–3 show a preferred embodiment of the present invention wherein the apparatus includes a housing 10 extending along longitudinal axis 12. Housing 10 is, for example, hollow, having openings 14 and 16 at opposing ends. A cutting member or tool 18 is inserted within housing 10 and secured in a desired position by set screw 20. Cutting tool 18 is preferably of conventional nature, being, for example, a double ended, four fluted steel end mill cutting tool which is cut in half or ground flat at face 22 opposite cutting face 24. As shown, cutting face 24 includes, for example, four cutting edges 26, one corresponding with each flute.

It has been found that while each size or caliber case 30 may have a different diameter 32, several different size cases share the same case shoulder inclination 34. Thus, the present invention advantageously indexes from the datum of the case shoulder.

To accomplish this, a ledge 40 is formed in housing 10. This ledge can be either integrally formed into the housing, as by direct machining, or, more preferably, removably attachable by use of a separable plug 42. The ledge serves to positively locate case 30 with respect to cutting tool 18 and as a stop against further trimming past a predetermined position. Plug 42 is preferably received within opening 16 by a snug or interference fit. Opening 44 is provided in plug 42 to receive open end 36 of case 30, leaving a portion of case 30 protruding from housing 10. Opening 44, or opening 16 if ledge 40 is integrally formed in housing 10, is dimensioned to receive case 30 closely but to still allow free rotation of the case with respect to housing 10.

In manufacture, housing 10 is preferably formed from commercially available 12L14 steel. Plug 42 is preferably formed as a solid piece of Delrin plastic and machined to the desired configuration of ledge 40. Since each plug 42 is removable and accommodates a plurality of case sizes, virtually all reloadable cases can be accommodated with relatively few substitute plugs.

Cutting edges 26 are sharp and pose a risk of injury to the user if handled. Accordingly, with the present invention the cutting edges are completely enclosed within housing 10 during trimming of case 30. Sufficient space is provided within housing 10 and the open end of case 30 to permit shavings to be collected and retained. In particular embodiments, an opening 46 is provided in housing 10 to permit shavings to be removed during trimming to a confined location. If no opening 46 is employed, housing 10 can be periodically inverted to clean out shavings.

In operation, once the user determines the desired change 38 in the length of case 30, the position of cutting tool 18 is adjusted by loosening set screw 20 and sliding cutting tool 18 along axis 12 within housing 10. A conventional measuring device, such as the tail end of a dial caliper, can be readily inserted within opening 14 to abut face 22 and determine the relative position of cutting tool 18. Thus, it is not necessary for a measuring device to contact cutting edges 26 in order to properly position the cutting tool. Once the desired position of cutting tool 18 is obtained and set screw 20 is retightened to maintain that position, case 30 is inserted into housing 10 such that its open end engages cutting edges 26. Housing 10 automatically maintains alignment of case 30 and cutting tool 18. Sufficient pressure is applied to case 30 and housing 10 to maintain that engagement and those two elements are then rotated with respect to each other so as to permit cutting edges 26 to trim away portion 38 of case 30. Ledge 40 will stop trimming beyond the predetermined amount although, preferably, that rotation is maintained a few revolutions after cutting has stopped so as to provide a fine finish. For trimming different size cases not covered by the ledge of plug 42, that plug is replaced with another of the correct shoulder inclination.

Relative rotation between case 30 and housing 10 can be provided manually or, through adapter 50, by a conventional power tool, such as an electric hand drill. Adapter 50 includes a cavity 52 from receiving one end of housing 10, a set screw 54 from securing housing 10 in a fixed relation to adapter 50, and a projection 56, such as a ¼ inch diameter post, receivable by the chuck of the electric drill.

Thus, the present invention provides a compact, versatile trimming apparatus that does not require a special stand or platform and can speedily and safely shorten case lengths for a multitude of different case sizes.

Although the present invention has been described above in detail with respect to preferred embodiments, the same is by way of illustration and example only and is not to be taken as a limitation. Those of ordinary skill in the art will now recognize that various adaptations of the present invention can be made for particular situations. The spirit and scope of the present invention are limited only by the terms of the appended claims.

What is claimed is:

1. An apparatus for trimming the length of a firearm cartridge case, including:

a hand-holdable device comprising;

a cutting member for trimming the length of the case, housing means for enclosing therein the cutting member, adjustable means for non-rotatably fixing the location of the cutting member with respect to the housing means during trimming operations, and stop means, within the housing means, for rotatably receiving a shoulder portion of the case and positively locating the case with respect to the cutting member.

2. The apparatus according to claim 1 wherein the adjustable means permits the cutting member to slide between different locations within the housing means relative to the stop means prior to trimming operations.

3. The apparatus according to claim 2 wherein the housing means includes a first opening therein for permitting measurement of the cutting member position by an external device.

4. The apparatus according to claim 1 wherein the housing means includes a chamber therein for collecting case shavings.

5. The apparatus according to claim 4 wherein the housing means includes a second opening therein to the chamber for permitting removal of case shaving from the chamber during trimming.

6. The apparatus according to claim 1 wherein the stop means and is removable from the housing so as to permit use of differently sized stop means for different size cases.

7. The apparatus according to claim 1 further including an adaptive member for receiving the housing means and being connected to a standard, rotatable power tool for causing relative rotation between the case and the cutting member.

8. An apparatus for alternatively trimming the length of a variety of differently sized firearm cartridge cases via manual or power tool actuation, comprising:

a variably positionable cutting member having an end mill cutting edge for trimming the length of a case, a longitudinally extending, hollow housing sized to receive the cutting member within one end, said cutting member being non-rotatably mounted within said housing, and an interchangeable stop means within the other end of the housing for rotatably receiving a shoulder of the case and positioning it with respect to the cutting member.

9. The apparatus according to claim 8 wherein the cutting member is shorter in length than the housing and totally enclosed within the housing during use, is removably received within the housing, the cutting member includes an end wall opposite its cutting edge, and the housing includes an opening which permits access to the end wall by a measuring instrument when the cutting member is received within the housing in order to determine the relative position of the cutting member with respect to the stop means.

10. The apparatus according to claim 9 wherein the stop means includes a ledge to engage the shoulder of the case to restrict excess movement of the case toward the cutting edge during trimming.

11. The apparatus according to claim 10 wherein the stop means is removably mounted to the housing and the housing and stop means retain the case and cutting member in a manner that permits relative rotation between the case and cutting member during trimming.

12. The apparatus according to claim 11 wherein a power tool adapter means is provided for receiving and securing therein a portion of the housing, connecting the housing to a standard sized power tool chuck and transmitting rotational force from the power tool to the housing.

13. The apparatus according to claim 10 wherein the stop means is removably attached to the housing and the housing is receives a variety of different stop means, each having different ledges to accommodate one or more different sized cases.

14. A method of trimming the length of a case for a firearm cartridge, comprising:

inserting the case within a housing enclosing a cutting edge of a cutting tool, said cutting tool being non-rotatably mounted within said housing, apply pressure to maintain an open end of the case against the cutting edge while applying relative rotation between the case and the cutting tool, and discontinue trimming after a shoulder of the case abuts an internal ledge in the housing.

* * * * *